US009842708B1

(12) United States Patent
Tumu et al.

(10) Patent No.: US 9,842,708 B1
(45) Date of Patent: Dec. 12, 2017

(54) CIRCUIT BREAKER LATCH MECHANISM INTEGRATED INTO THE ROTOR ASSEMBLY

(71) Applicant: General Electric Company, Schenectady, NY (US)

(72) Inventors: Nagesh V. Tumu, Plainville, CT (US); Wolfgang Meyer-Haack, Neumunster (DE); Dhirendra Tiwari, Farmington, CT (US); Amit Bose, Andhra Pradesh (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 15/172,903

(22) Filed: Jun. 3, 2016

(51) Int. Cl.
*H01H 3/20* (2006.01)
*H01H 1/20* (2006.01)
*H01H 71/02* (2006.01)

(52) U.S. Cl.
CPC ..... *H01H 1/205* (2013.01); *H01H 71/0207* (2013.01)

(58) Field of Classification Search
CPC .... H01H 1/205; H01H 1/2041; H01H 1/2058; H01H 71/504; H01H 71/505; H01H 2071/506
USPC ..... 200/400, 411; 335/15, 21, 43, 167, 168, 335/171
See application file for complete search history.

(56) References Cited

U.S. PATENT DOCUMENTS 3,134,879 A 5/1964 Gauthier et al.
4,409,573 A * 10/1983 Di Marco ..... H01H 77/104 335/16
4,638,277 A 1/1987 Thomas et al.
5,565,827 A 10/1996 Gula et al.
5,793,270 A 8/1998 Beck et al.
6,084,489 A 7/2000 Castonguay et al.
6,326,868 B1 12/2001 Kranz et al.
7,005,594 B2 * 2/2006 Kim ..... H01H 77/104 200/244
7,943,873 B2 5/2011 Gopikrishnan et al.
7,977,592 B2 * 7/2011 Shmukler ..... H01H 1/205 200/244
8,089,016 B2 * 1/2012 Dahl ..... H01H 1/2041 200/400
8,395,063 B2 3/2013 Lagiewka et al.
(Continued)

FOREIGN PATENT DOCUMENTS

JP 2001143597 A 5/2001

*Primary Examiner* — Vanessa Girardi
(74) *Attorney, Agent, or Firm* — General Electric Company

(57) ABSTRACT

A circuit breaker includes an electrically insulative case and a rotor assembly disposed within the electrically insulative case. The rotor assembly includes a contact arm and a rotor that is rotatable relative to the electrically insulative case. The contact arm is coupled to the rotor and movable between a first position in which a conductive path is closed and a second position in which the conductive path is open. The rotor assembly also includes a latch mechanism coupled to the rotor. The latch mechanism retains the contact arm in the second position during a short circuit event. The latch mechanism is spaced from the contact arm when the contact arm is in the first position. The latch mechanism engages the contact arm when the contact arm is in the second position.

22 Claims, 7 Drawing Sheets

(56) References Cited

U.S. PATENT DOCUMENTS 8,680,409 B2 * 3/2014 Birner ..... H01H 1/2041
200/11 R
9,287,061 B1 * 3/2016 Biedunkiewicz ..... H01H 1/205

* cited by examiner

CIRCUIT BREAKER LATCH MECHANISM INTEGRATED INTO THE ROTOR ASSEMBLY

BACKGROUND

The field of the disclosure relates generally to circuit breakers and, more particularly, to circuit breakers including rotatable contact arms.

Circuit breakers are often used to protect, in a residential, industrial, utility, or commercial environment, against overcurrent conditions, ground fault conditions, or other system anomalies that are undesirable and require the circuit breaker to interrupt the flow of current through the circuit breaker. In some circuit breakers, a movable contact is separated from a stationary contact when the circuit breakers experience an overcurrent condition, such as a short circuit event. Separating the circuit breaker contacts, generally referred to as "tripping" the circuit breaker when caused by protection reasons or "opening" the circuit breaker when caused by control reasons, interrupts the flow of current through the circuit breaker.

In industrial settings, for example, the circuit breaker serves to prevent damage to equipment and machines that, in many cases, represent a significant investment by a business and on whose operation the business relies. The circuit breaker carries out this function by interrupting electrical current between the equipment and a power center or transformer when the circuit breaker contacts are separated. However, sometimes the circuit breaker contacts may not remain separated during an overcurrent condition. For example, sometimes after separating from the stationary contact, the movable contact rebounds and moves back towards the stationary contact. Accordingly, at least some known circuit breakers include retention systems that retain the movable contact in a position separated from the stationary contact. However, the retention systems increase the amount of force required to separate the contacts. As a result, the contacts do not fully separate to interrupt the flow of current through the circuit breaker in some overcurrent conditions, which may impact operation of equipment and machines. Moreover, the retention systems increase the cost and time required to assemble the circuit breakers.

BRIEF DESCRIPTION

In one aspect, a circuit breaker is provided. The circuit breaker includes an electrically insulative case and a rotor assembly disposed within the electrically insulative case. The rotor assembly includes a contact arm and a rotor that is rotatable relative to the electrically insulative case. The contact arm is coupled to the rotor and movable between a first position in which a conductive path is closed and a second position in which the conductive path is open. The rotor assembly also includes a latch mechanism coupled to the rotor. The latch mechanism retains the contact arm in the second position during a short circuit event. The latch mechanism is spaced from the contact arm when the contact arm is in the first position. The latch mechanism engages the contact arm when the contact arm is in the second position.

In another aspect, a rotor assembly for a circuit breaker is provided. The rotor assembly includes a contact arm and a rotor that is rotatable relative to an electrically insulative case. The contact arm is coupled to the rotor and movable between a first position in which a conductive path is closed and a second position in which the conductive path is open. The rotor assembly also includes a latch mechanism coupled to the rotor. The latch mechanism retains the contact arm in the second position during a short circuit event. The latch mechanism is spaced from the contact arm when the contact arm is in the first position. The latch mechanism engages the contact arm when the contact arm is in the second position.

In yet another aspect, a method of manufacturing a circuit breaker is provided. The method includes coupling a rotor to the electrically insulative case. The rotor is rotatable relative to the electrically insulative case. The method also includes coupling an operating mechanism to the rotor. Actuation of the operating mechanism causes the rotor to rotate. The method further includes coupling a movable contact to the rotor. The movable contact is movable between a first position in which a conductive path is closed and a second position in which the conductive path is open. The method also includes coupling a latch mechanism to the rotor. The latch mechanism inhibits movement of the movable contact when the movable contact is in the second position. The latch mechanism is spaced from the movable contact when the movable contact is in the first position. The latch mechanism engages the movable contact when the movable contact is in the second position.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "substantially," and "approximately," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Exemplary embodiments of circuit breakers and methods of manufacturing circuit breakers are described herein. The circuit breakers generally include a contact arm that moves between a first position engaged with a stationary contact and a second position disengaged from the stationary contact. In some embodiments, the contact arm is retained in the second position by a latch mechanism. In particular, the latch mechanism is spaced from the contact arm when the contact arm is in the first position and the latch mechanism engages the contact arm when the contact arm moves to the second position during a short circuit event.

Figure 1:
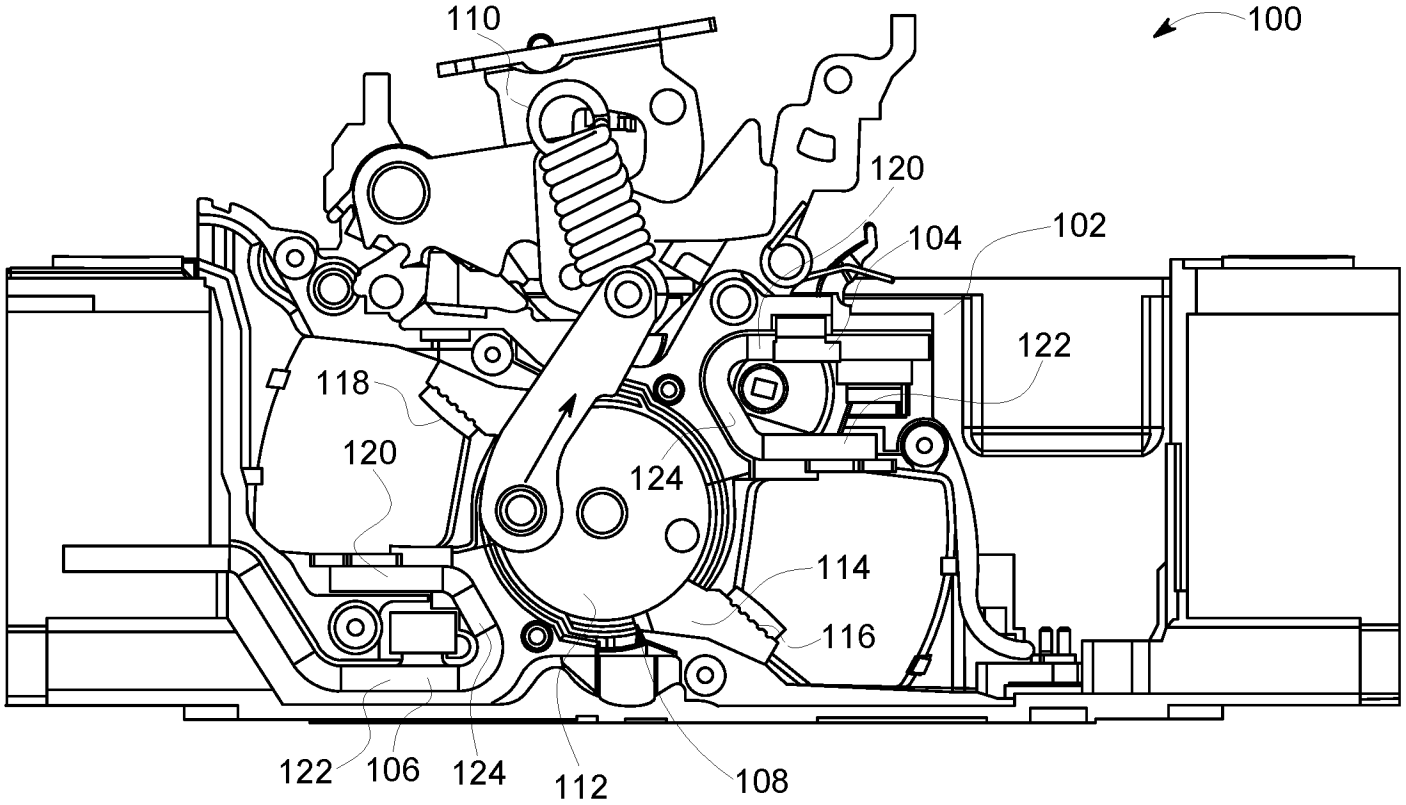
FIG. 1 is a section view of a circuit breaker assembly including a contact arm of a rotor assembly in a second position.
Figure 2:
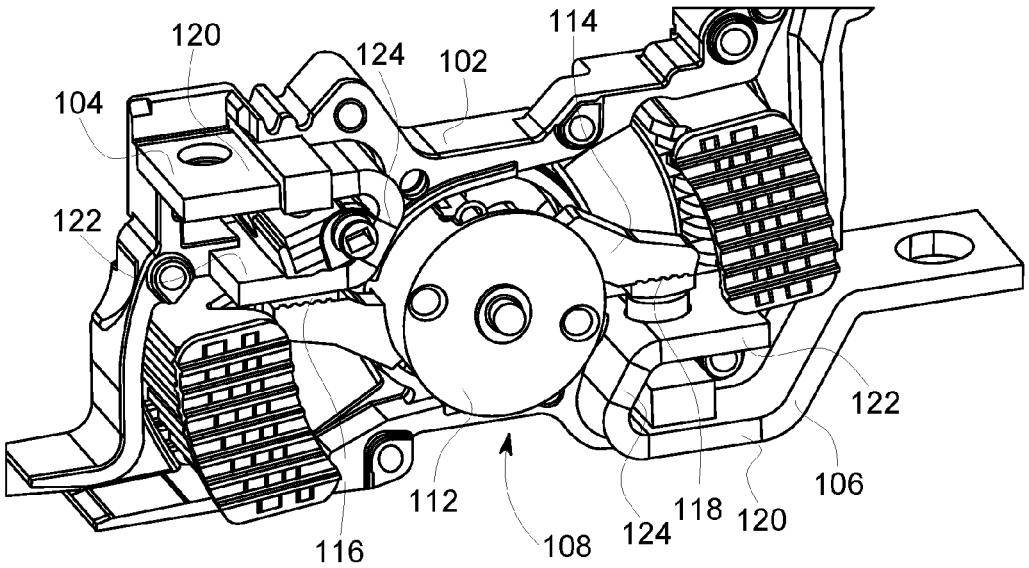
FIG. 2 is a perspective view of a portion of the circuit breaker assembly shown in FIG. 1 with the contact arm in a first position.

FIG. 1 is a section view of a circuit breaker 100. FIG. 2 is a perspective view of a portion of circuit breaker 100. Circuit breaker 100 includes a case 102, a load strap 104, a line strap 106, a rotor assembly 108, and an operating mechanism 110. Case 102 electrically insulates circuit breaker 100 such that electrical current is inhibited from passing through case 102 to the surrounding environment. Operating mechanism 110 is operatively coupled to rotor assembly 108 and rotates rotor assembly 108 upon actuation of operating mechanism 110. In alternative embodiments, circuit breaker 100 includes any components that enable circuit breaker 100 to operate as described herein. For example, in some embodiments, circuit breaker 100 includes a plurality of cases 102, load straps 104, line straps 106, rotor assemblies 108, and/or operating mechanisms 110. In the exemplary embodiment, circuit breaker 100 is coupled to a circuit such that circuit breaker 100 controls flow of electric current through the circuit. In particular, when operating mechanism 110 of circuit breaker 100 is actuated and rotor assembly 108 is rotated, the flow of electric current through the circuit coupled to circuit breaker 100 is stopped.

In the exemplary embodiment, rotor assembly 108 includes a rotor 112 and a contact arm 114. Contact arm 114 includes a load contact 116 selectively contacting load strap 104 and a line contact 118 selectively contacting line strap 106. Contact arm 114 is coupled to rotor 112 such that rotation of rotor 112 causes contact arm 114 to move between a first position (shown in FIG. 2) where contact arm 114 engages load strap 104 and line strap 106 and a second position (shown in FIG. 1) where contact arm 114 is disengaged from load strap 104 and line strap 106 due to a short circuit event. Accordingly, contact arm 114 is a movable contact and load strap 104 and line strap 106 are stationary contacts. In alternative embodiments, circuit breaker 100 includes any contacts that enable circuit breaker 100 to operate as described herein.

Also, in the exemplary embodiment, each of load strap 104 and line strap 106 includes a first leg 120, a second leg 122, and a curved segment 124 interconnecting first leg 120 and second leg 122. As such, load strap 104 and line strap 106 have a U-shape. Load strap 104 and line strap 106 include an electrically conductive material to facilitate current flowing through load strap 104 and line strap 106. During operation of circuit breaker 100, at least one of load strap 104 and line strap 106 generates repulsive forces when a predetermined current flows through load strap 104 and/or line strap 106. In particular, the reverse loops of load strap 104 and line strap 106 generate repulsive forces that repel load contact 116 and line contact 118 from load strap 104 and line strap 106. As a result, contact arm 114 is disengaged from load strap 104 and line strap 106 and current is inhibited from flowing through the circuit coupled to circuit breaker 100, i.e., circuit breaker 100 is tripped. In alternative embodiments, load strap 104 and line strap 106 have any configuration that enables circuit breaker 100 to operate as described herein.

Figure 3:
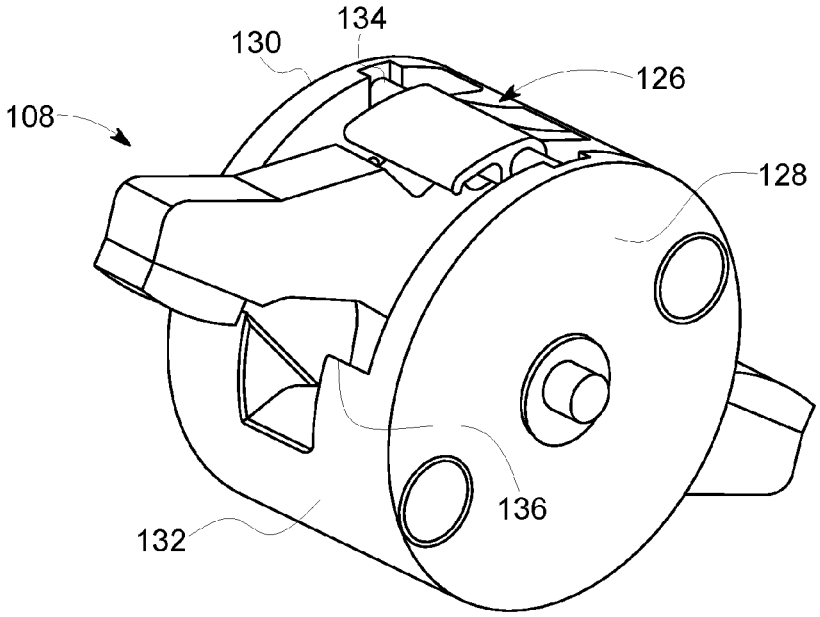
FIG. 3 is a perspective view of a rotor assembly of the circuit breaker assembly shown in FIG. 1.

FIG. 3 is a perspective view of rotor assembly 108. Rotor 112 of rotor assembly 108 includes a first end 128, a second end 130, a sidewall 132, and rotor pins 134. In the illustrated embodiment, first end 128 and second end 130 are circular and rotor 112 has a cylindrical shape. Sidewall 132 extends between first end 128 and second end 130 and defines openings 136. Rotor pins 134 extend between first end 128 and second end 130 adjacent openings 136. Contact arm 114 extends at least partially through an interior of rotor 112 and through openings 136. Moreover, contact arm 114 has some freedom of movement relative to rotor 112. In alternative embodiments, rotor 112 has any configuration that enables circuit breaker 100 to operate as described herein.

Figure 4:
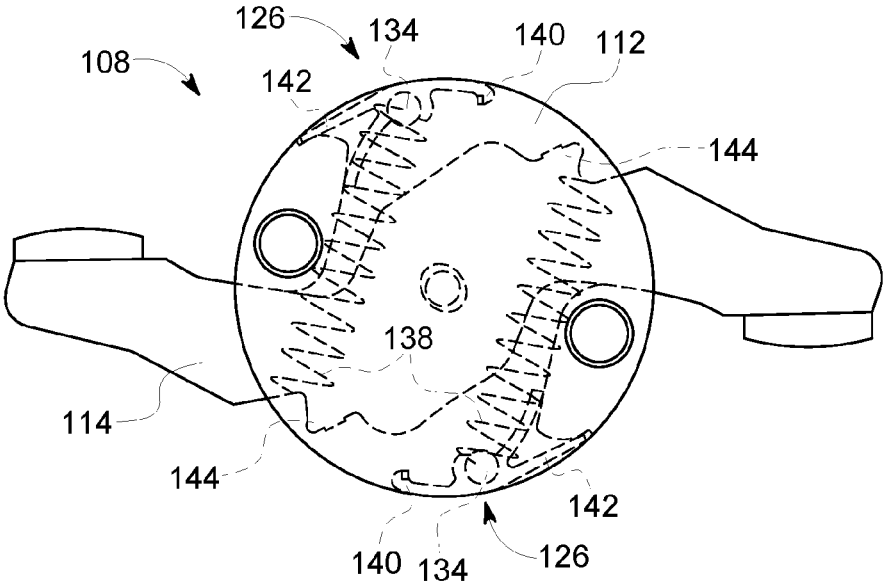
FIG. 4 is a section view of a rotor assembly of the circuit breaker shown in FIG. 3 with a contact arm and latch mechanism disengaged, wherein the contact arm is in a first position and the latch mechanism is in a neutral position.
Figure 5:
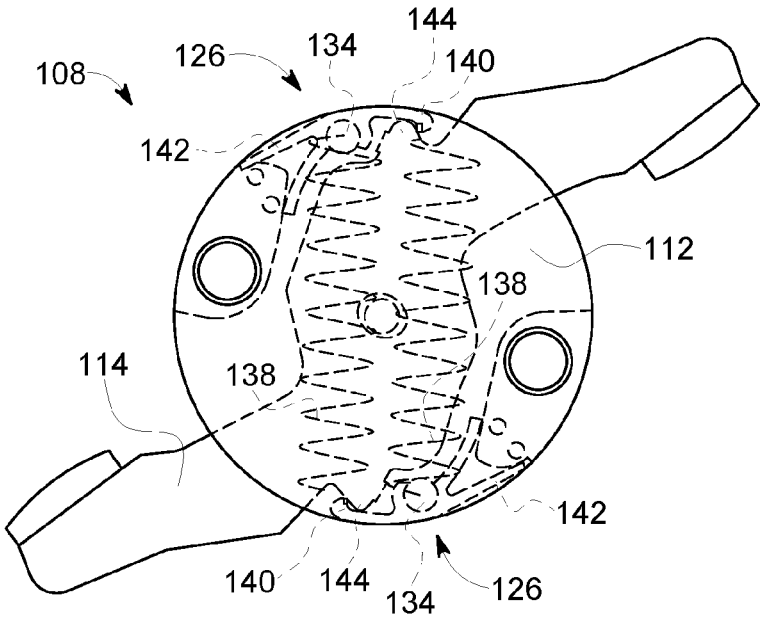
FIG. 5 is a section view of the rotor assembly shown in FIG. 4 with the contact arm and latch mechanism engaged, wherein the latch mechanism maintains the contact arm in a second position.

FIG. 4 is a section view of rotor assembly 108 with contact arm 114 and latch mechanisms 126 disengaged. FIG. 5 is a section view of rotor assembly 108 with contact arm 114 and latch mechanisms 126 engaged. Rotor assembly 108 includes latch mechanisms 126 to retain contact arm 114 in the second position when contact arm 114 moves to the second position without rotation of rotor 112. Latch mechanisms 126 are coupled to opposite sides of rotor 112. As shown in FIG. 4, each latch mechanism 126 is spaced from contact arm 114 when contact arm 114 is in the first position. As shown in FIG. 5, each latch mechanism 126 engages contact arm 114 when contact arm 114 is in the second position and rotor 112 has not rotated. Accordingly, latch mechanisms 126 retain contact arm 114 in the second position when circuit breaker 100 is subject to high current. Moreover, as will be discussed below, latch mechanisms 126 reduce the torque required to position contact arm 114 in the second position and increase the torque required to return contact arm 114 to the first position. As a result, latch mechanisms 126 allow circuit breaker 100 to hold contact arm 114 in the second position under lower level overcurrent conditions and facilitate circuit breaker 100 remaining in an open position until operating mechanism 110 is actuated to reset circuit breaker 100 and settle at a trip open position.

In the exemplary embodiment, each latch mechanism 126 includes a head 140 and a biasing mechanism 142. Head 140 engages contact arm 114 and is movable between a neutral position and a displaced position. In the exemplary embodiment, contact arm 114 further includes a catch 144 to engage head 140. Biasing mechanism 142 resists displacement of head 140 and biases head 140 towards the neutral position. In particular, biasing mechanism 142 extends between head 140 and rotor 112 to exert forces on rotor 112 and head 140. In the illustrated embodiment, biasing mechanism 142 includes a plurality of leaf springs. In alternative embodiments, latch mechanism 126 has any configuration that enables rotor assembly 108 to function as described herein.

Also, in the exemplary embodiment, latch mechanism 126 is coupled to rotor pin 134 such that latch mechanism 126 rotates with rotor 112. In particular, latch mechanism 126 is coupled to rotor pin 134 such that rotor pin 134 extends between head 140 and biasing mechanism 142. As a result, latch mechanism 126 pivots about rotor pin 134. Coupling latch mechanism 126 to rotor 112 reduces the number of additional parts required to incorporate latch mechanism 126 into circuit breaker 100. Moreover, latch mechanism 126 enables rotor assembly 108 to have a compact size. In alternative embodiments, latch mechanism 126 is coupled to any portions of circuit breaker 100 that enable latch mechanism 126 to function as described herein.

Moreover, in the exemplary embodiment, latch mechanism 126 is made of a flexible material with structural strength. In addition, head 140 and biasing mechanism 142 are integrally formed as a single piece. In alternative embodiments, latch mechanism 126 is made of any material and in any manner that enables latch mechanism 126 to function as described herein. For example, in some embodiments, latch mechanism 126 is made of any of the following materials, without limitation: thermoplastics, metals, springs, and combinations thereof.

Figure 6A:
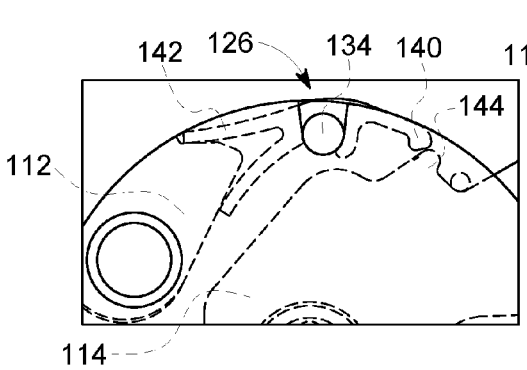
FIG. 6A is a schematic view of a latch mechanism in a neutral position and a contact arm of the rotor assembly shown in FIG. 4 in a first position.
Figure 6B:
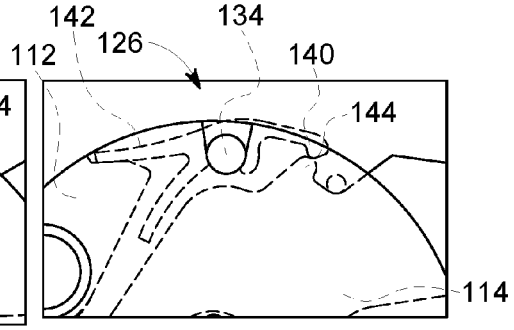
FIG. 6B is a schematic view of the latch mechanism in a displaced position and the contact arm moving from the first position toward a second position.
Figure 6C:
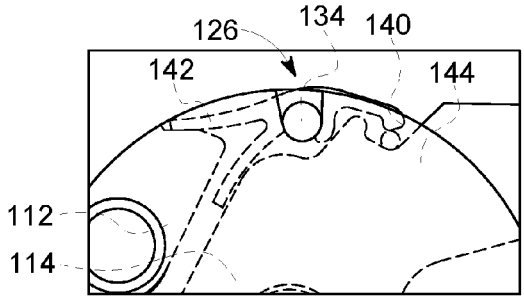
FIG. 6C is a schematic view of the latch mechanism moving toward the neutral position and the contact arm moving toward the second position.
Figure 6D:
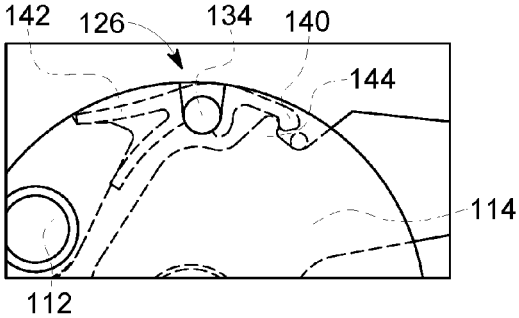
FIG. 6D is a schematic view of the latch mechanism in a neutral position and retaining the contact arm in the second position.
Figure 7A:
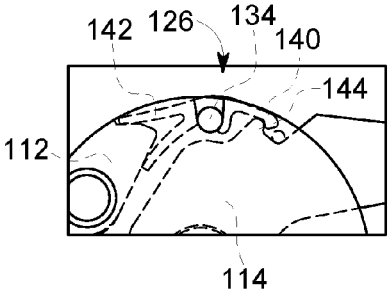
FIG. 7A is a schematic view of the latch mechanism in a neutral position and the contact arm in the second position.
Figure 7B:
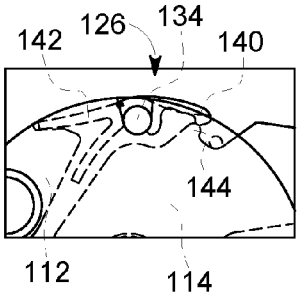
FIG. 7B is a schematic view of the latch mechanism in the displaced position and the contact arm moving from the second position toward the first position.
Figure 7C:
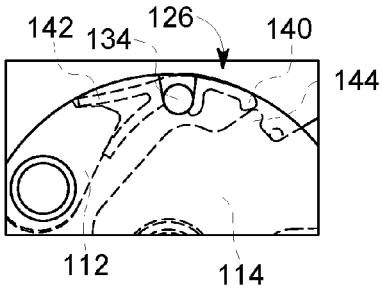
FIG. 7C is a schematic view of the latch mechanism in the neutral position and the contact arm in the second position.

FIG. 6A is a schematic view of latch mechanism 126 in a neutral position and contact arm 114 in a first position. FIG. 6B is a schematic view of latch mechanism 126 in a displaced position and contact arm 114 moving from the first position toward a second position. FIG. 6C is a schematic view of latch mechanism 126 moving toward the neutral position and contact arm 114 moving toward the second position. FIG. 6D is a schematic view of latch mechanism 126 in the neutral position and latch mechanism 126 retaining contact arm 114 in the second position. FIG. 7A is a schematic view of latch mechanism 126 in the neutral position and contact arm 114 in the second position. FIG. 7B is a schematic view of latch mechanism 126 in the displaced position and contact arm 114 moving from the second position toward the first position. FIG. 7C is a schematic view of latch mechanism 126 in the neutral position and contact arm 114 in the second position.

During a high fault current event, contact arm 114 moves to the second position and contacts latch mechanism 126 to cause head 140 to move from the neutral position to the displaced position. When head 140 is displaced, biasing mechanism 142 biases head 140 towards the neutral position and head 140 engages catch 144. As a result, contact arm 114 is retained in the second position by the engagement of head 140 and catch 144. Latch mechanism 126 and contact arm 114 are disengaged when operating mechanism 110 (shown in FIG. 1) is actuated to cause rotation of rotor 112. Rotation of rotor 112 causes latch mechanism 126 to move away from contact arm 114. However, case 102 (shown in FIG. 1) inhibits contact arm 114 moving with rotor 112 and latch mechanism 126. As a result, head 140 is displaced by contact arm 114 and disengages from catch 144 as latch mechanism 126 moves away from contact arm 114. In alternative embodiments, latch mechanism 126 and contact arm 114 engage in any manner that enables circuit breaker 100 to operate as described herein.

In reference to FIGS. 4 and 5, rotor assembly 108 further includes rotor biasing devices 138 coupled to and extending between rotor pins 134 and contact arm 114 to bias contact arm 114 to the first position. When contact arm 114 is in the first position, rotor biasing devices 138 maintain contact pressure and conductivity between contact arm 114 and both load strap 104 and line strap 106. Accordingly, the repulsive forces generated by load strap 104 and line strap 106 must overcome the biasing forces of the rotor biasing devices 138 to cause contact arm 114 to move to the second position during an overcurrent condition. In the exemplary embodiment, rotor biasing devices 138 include coil springs. In alternative embodiments, rotor assembly 108 includes any rotor biasing devices 138 that enable circuit breaker 100 to operate as described herein. For example, in some embodiments, rotor assembly 108 includes a single rotor biasing device 138.

Figure 8:
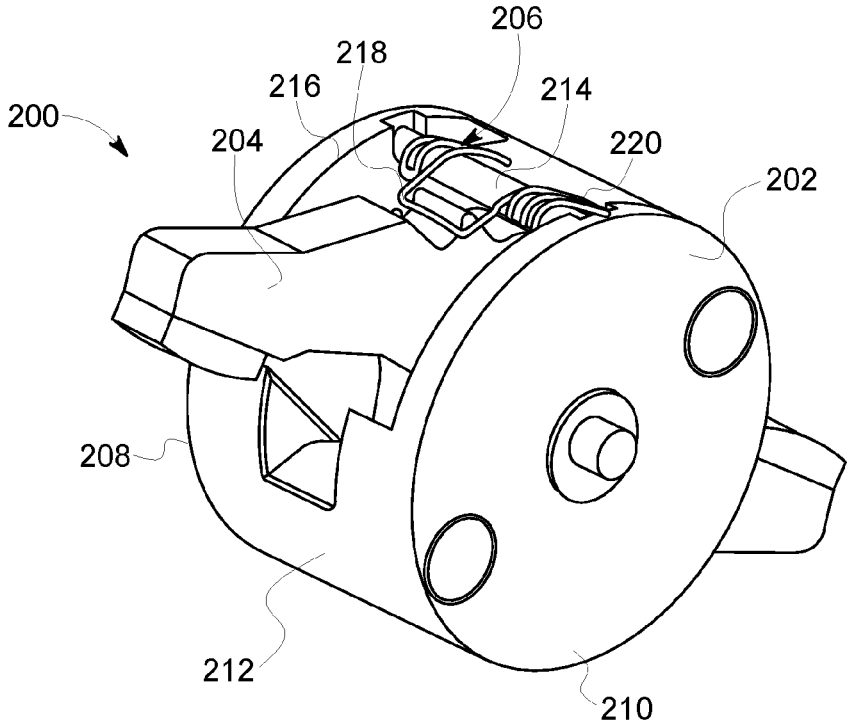
FIG. 8 is a perspective view of an alternative rotor assembly for the circuit breaker assembly shown in FIG. 1.

FIG. 8 is a perspective view of an alternative rotor assembly 200 for circuit breaker 100. Rotor assembly 200 includes a rotor 202, a contact arm 204, and a latch mechanism 206. Rotor 202 includes a first end 208, a second end 210, a sidewall 212, and rotor pins 214. Contact arm 204 extends at least partially through openings 216 in rotor 202 and is free to move relative to rotor 202. Rotor pins 214 extend adjacent openings 216. In alternative embodiments, rotor 202 has any configuration that enables rotor assembly 200 to function as described herein.

In the exemplary embodiment, latch mechanism 206 includes a head 218 and a biasing mechanism 220. Head 218 is movable between a neutral position and a displaced position. Biasing mechanism 220 resists displacement of head 218 and biases head 218 towards the neutral position. In the exemplary embodiment, head 218 and biasing mechanism 220 are formed by a wire partially wrapped around rotor pin 214. In alternative embodiments, rotor assembly 200 includes any latch mechanism 206 that enables rotor assembly 200 to function as described herein.

Figure 9:
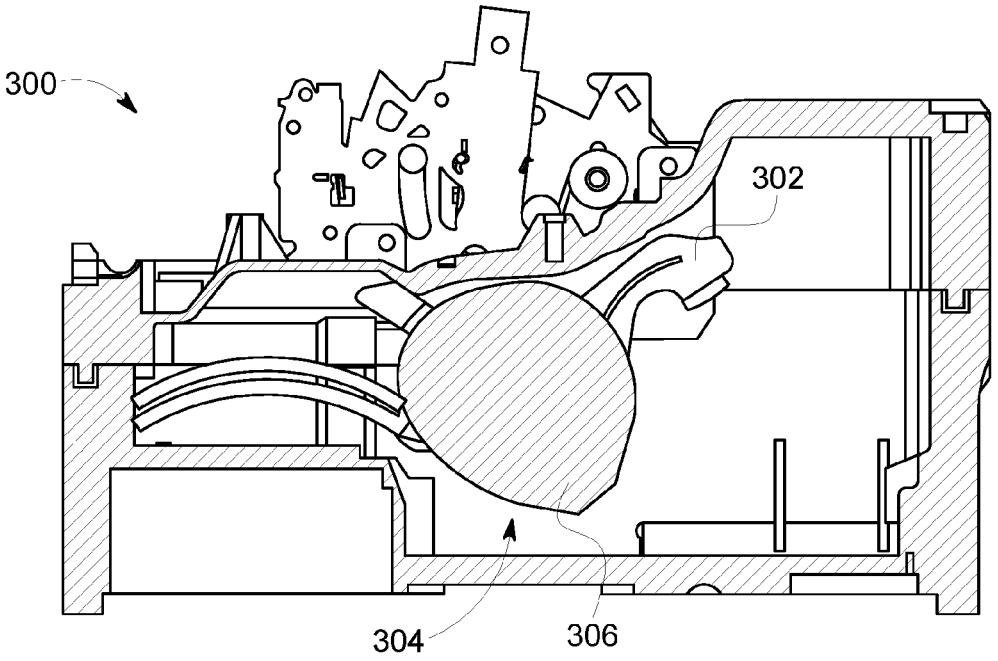
FIG. 9 is a section view of a circuit breaker assembly including a plurality of contact arms.
Figure 10:
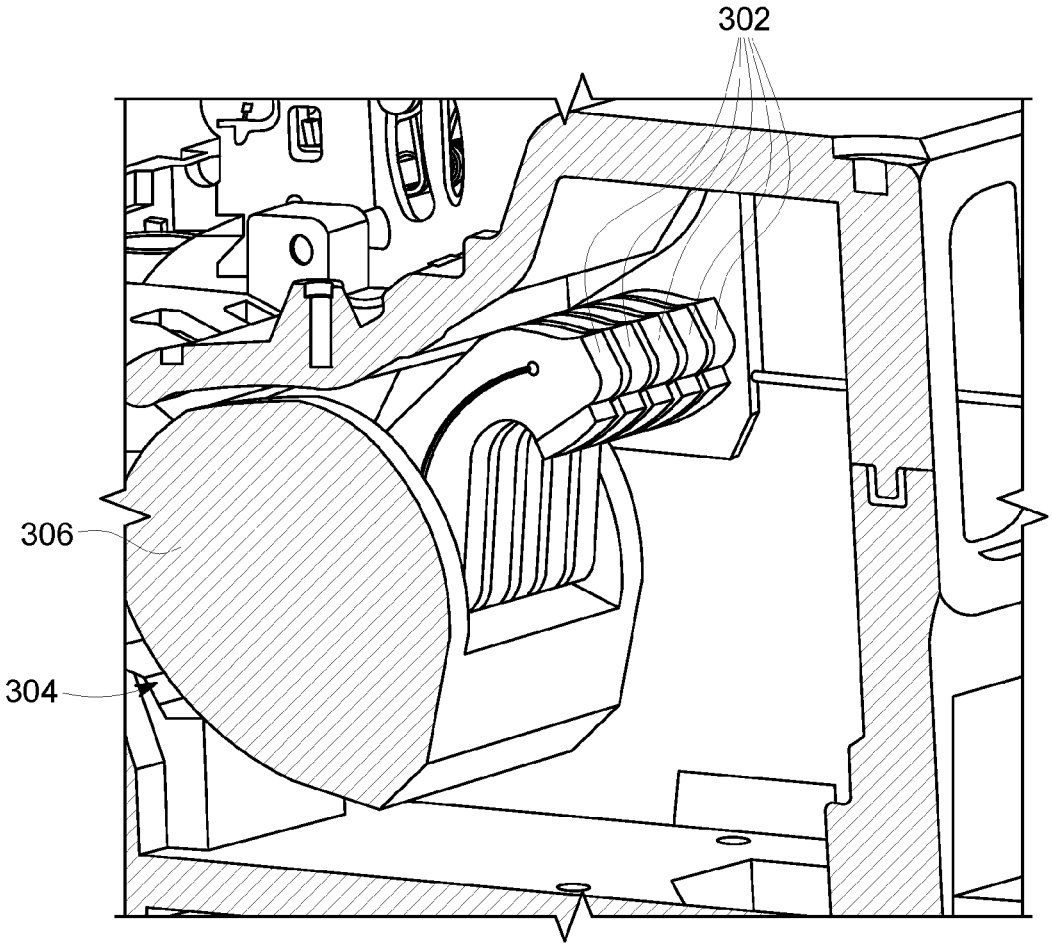
FIG. 10 is a perspective view of a portion of the circuit breaker assembly shown in FIG. 9.

FIG. 9 is a section view of an alternative circuit breaker 300 including a plurality of contact arms 302. FIG. 10 is a perspective view of a portion of circuit breaker 300. Circuit breaker 300 includes a rotor assembly 304 including contact arms 302, a rotor 306, and a latch mechanism (not shown). Rotor 306 rotates between a closed position and a tripped or open position. In addition, contact arms 302 are movable between a first position contacting a stationary contact (not shown) and a second position spaced from the stationary contact during a high fault current event. The latch mechanism (not shown) engages contact arms 302 to retain contact arms 302 in the second position when rotor 306 is in the neutral position. The latch mechanism (not shown) is similar to latch mechanism 126 of circuit breaker 100. Latch mechanism (not shown) engages each contact arm of circuit breaker 300. In the illustrated embodiment, circuit breaker 300 includes five contact arms 302 positioned alongside each other. In alternative embodiments, circuit breaker 300 includes any contact arms 302 and latch mechanisms that enable circuit breaker 300 to operate as described herein. For example, in some embodiments, circuit breaker 300 includes separate latch mechanisms engaging one or more contact arms 302. In further embodiments, circuit breaker 300 includes a latch mechanism including a plurality of heads and/or biasing mechanisms to enable the latch mechanism to engage a plurality of contact arms 302.

Figure 11:
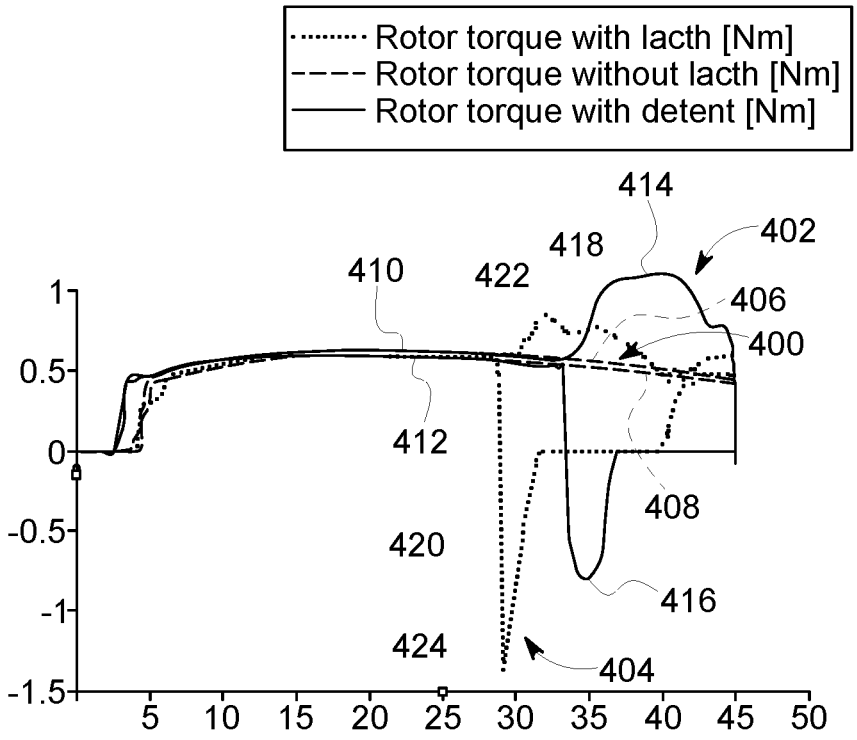
FIG. 11 is a graph showing torque profiles of rotor assemblies.

FIG. 11 is a graph showing torque profiles of rotor assemblies. FIG. 11 includes an X-axis defining angular position in degrees and a Y-axis defining torque in Newton-meters (Nm). The graph further includes a first curve 400, a second curve 402, and a third curve 404. First curve 400 illustrates torque required to position a contact arm without engaging a retaining system. First curve 400 includes a forward motion segment 406 and a reverse motion segment 408. Forward motion segment 406 and reverse motion segment 408 are substantially similar, with minor differences due to friction. In addition, first curve 400 is substantially constant because an approximately equal force is required to position the contact arm throughout the range of motion. Second curve 402 illustrates torque required to position a contact arm and engage a detent retaining system during a short circuit event. Second curve 402 includes a forward motion segment 410 and a reverse motion segment 412. Forward motion segment 410 has a peak 414 representing the torque required to engage the detent system. Reverse motion segment 412 has a valley 416 representing the torque required to disengage the detent system.

Third curve 404 illustrates torque required to position contact arm 114 and engage latch mechanism 126. Third curve 404 includes a forward motion segment 418 and a reverse motion segment 420. Forward motion segment 418 has a peak 422 representing the torque required to engage latch mechanism 126. Reverse motion segment 420 has a valley 424 representing the torque required to disengage latch mechanism 126. Notably, peak 422 is less than peak 414 because a reduced amount of energy is required to engage latch mechanism 126 compared to the detent system. As a result, latch mechanism 126 engages contact arm 114 during short circuit event at faster time compared to the detent system. For example, opening of the contact arm of the detent system is slowed due to peak 414. In addition, valley 424 has a greater magnitude than valley 416 because an increased amount of energy is required to disengage latch mechanism 126 compared to the detent systems. As a result, latch mechanism 126 better retains contact arm 114 in an open position and resists greater forces than detent systems.

In reference to FIGS. 1-3, a method of manufacturing circuit breaker 100 includes coupling load strap 104 and line strap 106 to case 102. The method also includes coupling rotor 112 to case 102 such that rotor 112 is rotatable relative to case 102. Operating mechanism 110 is coupled to rotor 112 such that operating mechanism 110 causes rotor 112 to rotate upon actuation of operating mechanism 110. Contact arm 114 is coupled to rotor 112 such that contact arm 114 is movable between a first position where contact arm 114 engages load strap 104 and line strap 106 and a second position where contact arm 114 is disengaged from load strap 104 and line strap 106. The method further includes coupling latch mechanism 126 to rotor 112 to inhibit movement of contact arm 114 when contact arm 114 moves to the second position without rotation of rotor 112 during a short circuit event. Latch mechanism 126 is positioned such that latch mechanism 126 is spaced from contact arm 114 when contact arm 114 is in the first position and engages contact arm 114 when contact arm 114 moves to the second position without rotation of rotor 112. In some embodiments, head 140 of latch mechanism 126 is positioned to engage contact arm 114 when contact arm 114 moves to the second position without rotation of rotor 112. In further embodiments, biasing mechanism 142 extends between head 140 and rotor 112 to bias head 140 towards the neutral position.

The circuit breakers described above generally include a contact arm that moves between a first position engaged with a stationary contact and a second position disengaged from the stationary contact. In some embodiments, the movable contact is retained in the second position by a latch mechanism. In particular, the latch mechanism is spaced from the contact arm when the contact arm is in the first position and the latch mechanism engages the contact arm when the contact arm moves to the second position without rotation of a rotor.

An exemplary technical effect of the methods, systems, and apparatus described herein includes at least one of: (a) reducing force required to trip circuit breakers; (b) improving interruption of high fault current using a movable contact arm; (c) reducing cost and time required to manufacture circuit breakers; (d) increasing operating efficiency of circuit breakers; (e) reducing the size of circuit breakers; (0 decreasing response time of circuit breakers to a short-circuit current; and (g) reducing damage to machines and equipment on a circuit protected by circuit breakers.

Exemplary embodiments of circuit breakers and methods of manufacturing circuit breakers are described above in detail. The circuit breakers and methods are not limited to the specific embodiments described herein but, rather, components of the circuit breakers and/or operations of the methods may be utilized independently and separately from other components and/or operations described herein. Further, the described components and/or operations may also be defined in, or used in combination with, other systems, methods, and/or devices, and are not limited to practice with only the circuit beakers and systems described herein.

The order of execution or performance of the operations in the embodiments of the disclosure illustrated and described herein is not essential, unless otherwise specified. That is, the operations may be performed in any order, unless otherwise specified, and embodiments of the disclosure may include additional or fewer operations than those disclosed herein. For example, it is contemplated that executing or performing a particular operation before, contemporaneously with, or after another operation is within the scope of aspects of the disclosure.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A circuit breaker comprising:

an electrically insulative case; and a rotor assembly disposed within said electrically insulative case, said rotor assembly comprising:

a rotor that is rotatable relative to said electrically insulative case;

a contact arm coupled to said rotor and movable between a first position in which a conductive path is closed and a second position in which the conductive path is open; and a latch mechanism coupled to said rotor, said latch mechanism retains said contact arm in the second position during a short circuit event, said latch mechanism spaced from said contact arm when said contact arm is in the first position, said latch mechanism engages said contact arm when said contact arm is in the second position.

2. The circuit breaker in accordance with claim 1, wherein said rotor assembly comprises a plurality of latch mechanisms and a plurality of contact arms, each latch mechanism selectively engaging at least one contact arm of said plurality of contact arms.

3. The circuit breaker in accordance with claim 1, wherein said contact arm comprises a catch that selectively engages said latch mechanism.

4. The circuit breaker in accordance with claim 1, wherein said rotor further comprises a rotor pin, said latch mechanism coupled to said rotor pin.

5. The circuit breaker in accordance with claim 4, wherein said rotor assembly further comprises at least one biasing mechanism coupled to said contact arm and said rotor pin to bias said contact arm towards the first position.

6. The circuit breaker in accordance with claim 1, wherein said latch mechanism comprises:

a head that selectively engages said contact arm, said head movable between a neutral position and a displaced position; and a biasing mechanism that biases said head towards the neutral position.

7. The circuit breaker in accordance with claim 6, wherein movement of said contact arm to the second position causes said head to move from the neutral position to the displaced position to allow said head to engage said contact arm.

8. The circuit breaker in accordance with claim 6, wherein said biasing mechanism extends between said head and said rotor such that said biasing mechanism exerts a force on said contact arm and said head when said head is moved between the neutral position and the displaced position.

9. The circuit breaker in accordance with claim 6 further comprising an operating mechanism coupled to said rotor assembly, wherein said latch mechanism disengages said contact arm when said operating mechanism is actuated.

10. The circuit breaker in accordance with claim 9, wherein said contact arm causes said head to move from the neutral position to the displaced position to allow said head to disengage said contact arm as said operating mechanism is actuated.

11. A rotor assembly for a circuit breaker, said rotor assembly comprising:

a rotor that is rotatable relative to an electrically insulative case;

a contact arm coupled to said rotor and movable between a first position in which a conductive path is closed and a second position in which the conductive path is open; and a latch mechanism coupled to said rotor, said latch mechanism retains said contact arm in the second position during a short circuit event, said latch mechanism spaced from said contact arm when said contact arm is in the first position, said latch mechanism engages said contact arm when said contact arm is in the second position.

12. The rotor assembly in accordance with claim 11, wherein said contact arm comprises a catch that selectively engages said latch mechanism.

13. The rotor assembly in accordance with claim 11, wherein said latching mechanism is a first latching mechanism coupled to a first side of said rotor, said rotor assembly comprising a second latching mechanism coupled to a second of said rotor opposite the first side.

14. The rotor assembly in accordance with claim 11, wherein said rotor further comprises a rotor pin, said latch mechanism coupled to said rotor pin.

15. The rotor assembly in accordance with claim 14 further comprising at least one biasing mechanism coupled to said contact arm and said rotor pin to bias said contact arm towards the first position.

16. The rotor assembly in accordance with claim 11, wherein said latch mechanism comprises:

a head that selectively engages said contact arm, said head movable between a neutral position and a displaced position; and a biasing mechanism that biases said head towards the neutral position.

17. The rotor assembly in accordance with claim 16, wherein movement of said contact arm to the second position causes said head to move from the neutral position to the displaced position to allow said head to engage said contact arm.

18. The rotor assembly in accordance with claim 16, wherein said biasing mechanism extends between said head and said rotor such that said biasing mechanism exerts a force on said rotor and said head when said head is moved between the neutral position and the displaced position.

19. A method of manufacturing a circuit breaker, said method comprising:

coupling a rotor to the electrically insulative case, wherein the rotor is rotatable relative to the electrically insulative case;

coupling an operating mechanism to the rotor, wherein actuation of the operating mechanism causes the rotor to rotate;

coupling a movable contact to the rotor, wherein the movable contact is movable between a first position in which a conductive path is closed and a second position in which the conductive path is open, and the movable contact moves between the first position and the second position during a short circuit event; and coupling a latch mechanism to the rotor, wherein the latch mechanism inhibits movement of the movable contact when the movable contact is in the second position, wherein the latch mechanism is spaced from the movable contact when the movable contact is in the first position, and wherein the latch mechanism engages the movable contact when the movable contact is in the second position.

20. The method in accordance with claim 19, wherein coupling a latch mechanism to the rotor comprises coupling a latch mechanism to the rotor, wherein the latch mechanism includes a head to selectively engage the movable contact when the movable contact is in the second position, the head movable between a neutral position and a displaced position.

21. The method in accordance with claim 20 wherein coupling a latch mechanism to the rotor comprises coupling a latch mechanism to the rotor, wherein the latch mechanism includes a biasing mechanism between the head and the rotor to bias the head towards the neutral position.

22. The method in accordance with claim 20, wherein coupling a movable contact to the rotor comprises coupling a movable contact to the rotor, the movable contact including a catch spaced a distance from the head of the latch mechanism when the movable contact is in the first position, the movable contact contacts the head and displace the head such that the head engages the catch when the movable contact is in the second position.

* * * * *